US009505983B2

(12) United States Patent
Friedrichs et al.

(10) Patent No.: US 9,505,983 B2
(45) Date of Patent: Nov. 29, 2016

(54) ADJUSTABLE CHARGING HOLE CLOSURE FOR CHARGING THE COKING OVEN CHAMBERS OF A COKING OVEN BATTERY

(75) Inventors: Manfred Friedrichs, Essen (DE); Helmut Dohle, Bochum (DE)

(73) Assignee: THYSSENKRUPP UHDE GMBH, Dortmund (DE)

( * ) Notice: Subject to any disclaimer, the term of this patent is extended or adjusted under 35 U.S.C. 154(b) by 611 days.

(21) Appl. No.: 13/983,315

(22) PCT Filed: Feb. 8, 2012

(86) PCT No.: PCT/EP2012/000564

§ 371 (c)(1),
(2), (4) Date: Aug. 2, 2013

(87) PCT Pub. No.: WO2012/107219

PCT Pub. Date: Aug. 16, 2012

(65) Prior Publication Data

US 2013/0313101 A1 Nov. 28, 2013

(30) Foreign Application Priority Data

Feb. 11, 2011 (DE) ..... 10 2011 011 075

(51) Int. Cl.
*C10B 25/20* (2006.01)
*C10B 25/24* (2006.01)
*C10B 31/02* (2006.01)

(52) U.S. Cl.
CPC ..... *C10B 25/20* (2013.01); *C10B 25/24* (2013.01); *C10B 31/02* (2013.01)

(58) Field of Classification Search
CPC ..... C10B 25/20; C10B 25/24; C10B 31/02; C10B 31/04
USPC ..... 202/250, 251, 247, 269, 244; 432/250
See application file for complete search history.

(56) References Cited

U.S. PATENT DOCUMENTS 2,203,698 A * 6/1940 Schmidt ..... C10B 25/24 202/250
4,186,056 A 1/1980 Muller et al.
4,236,972 A 12/1980 Campana
4,389,284 A * 6/1983 Cain ..... C10B 25/24 202/251
2011/0044789 A1 2/2011 Knoch et al.

FOREIGN PATENT DOCUMENTS

CN 201648291 11/2010
DE 2732245 1/1979

(Continued)

OTHER PUBLICATIONS

International Search Report for PCT/EP2012/000564, English translation attached to original, Both completed by the European Patent Office on Jun. 20, 2012, All together 5 Pages.

*Primary Examiner* — Jill Warden
*Assistant Examiner* — Joye L Woodard
(74) *Attorney, Agent, or Firm* — Brooks Kushman P.C.

(57) ABSTRACT

An adjustable chargehole closure for adjusting the closure cover of a charging hole in a coking oven chamber. The adjustable chargehole closure has as an inner frame for a closure cover, and the frame can be rotated both with respect to the closure cover and with respect to an outer frame, designed asymmetrically with respect to a vertical plane, so that the closure cover is displaced along a longitudinal axis when the inner frame is rotated in the horizontal plane. The position of the charging hole opening and the closure cover present therein on the ceiling of a coking oven chamber can thereby be changed without requiring construction measures on the ceiling of a coking oven chamber. The capability is in particular advantageous in order to match the position of the charging hole cover to the precise charging position of the charging machine.

7 Claims, 3 Drawing Sheets

(56) References Cited

FOREIGN PATENT DOCUMENTS

| | | |
|---|---|---|
| DE | 2942805 | 4/1980 |
| DE | 19743868 | 3/1999 |
| DE | 10145431 | 11/2003 |
| EP | 1002850 | 5/2000 |
| SU | 1468909 | 3/1989 |
| WO | 2009100815 | 8/2009 |

* cited by examiner

ADJUSTABLE CHARGING HOLE CLOSURE FOR CHARGING THE COKING OVEN CHAMBERS OF A COKING OVEN BATTERY

CROSS-REFERENCE TO RELATED APPLICATION

This application is the U.S. national phase of PCT Application No. PCT/EP2012/000564 filed on Feb. 8, 2012, which claims priority to German Patent Application No. 10 2011 011 075.5 filed on Feb. 11, 2011, the disclosures of which are incorporated in their entirety by reference herein.

BACKGROUND OF THE INVENTION

1. Field of the Invention

The invention relates to a device serving as a closure for a chargehole of a coke oven battery, with the said device being configured as an inner frame for a closure lid, and with this frame being twistable both versus the closure lid and versus an outer frame, and wherein the frame is of an asymmetric nature versus a vertical plane so that the closure lid is shifted in the horizontal plane along a longitudinal axis when twisting the inner frame. Thereby the position of the chargehole aperture and of the closure lid contained therein can be varied on the top of a coke oven chamber without this necessitating structural work on the top of a coke oven chamber. This is of a particular advantage in order to adapt the position of the chargehole lid to the exact charging position of the charging machine, thus causing no deviations from the precise charging position of the charging machine which in standard operation according to the state of the art in technology entails increased emission of coke oven gases from a coke oven.

2. Description of the Related Art

Carbonisation of coal is typically performed in cycles. Accordingly, coal carbonization is so executed that a coke oven chamber suitable for coal carbonization is charged with coal, then closed, and the coal is carbonized by heating to convert it to become coke, and the finished coke is pushed out from the coke oven chamber. In some versions, coke oven chambers are charged through the openings of coke oven chamber doors of the coke oven chamber. In other versions, charging is performed through the top of a coke oven chamber. The choice of the relevant version is usually left to the operating expert.

Variants for coke oven chambers charged through the top with coal destined for carbonisation are sufficiently known from prior art in technology. DE 19743868 A1 describes a coal charging car for charging coke oven chambers of a coke oven battery, including a funnel-shaped bottom outlet, a horizontal conveyor screw beneath the bottom outlet, and a lid lifting device to open and close chargehole lids of coke oven chambers. According to the invention, the casing of the conveyor screw is arranged horizontally movable at the underside of the coal charging car and movable by means of an actuator drive between a home position and a charging position, while the location of the charging car remains invariable. In the home position, the outlet nozzle is positioned laterally towards the chargehole.

Owing to the top loading, the expense of equipment otherwise required for charging in front of a coke oven chamber is eliminated. With a frontal loading through the aperture of a coke oven chamber door, loading machines are usually required which are complex in their dimensions and which need appropriate space in front of a coke oven chamber. This expense is eliminated applying the top loading procedure, but the top loading procedure calls for a precise positioning of the coal charging machine over the chargehole.

To insulate the coke oven chamber, the chargeholes are usually configured with a small cross-section in order to minimize heat loss from the coke oven chamber through the coke oven chamber top. Chargeholes of a smaller size in the coke oven chamber top may also contribute to keeping emissions at a low level. By way of structural measures, e.g. cladding with a refractory material, the chargeholes are solidly integrated into the coke oven chamber top. However, since the roof top structures of coke oven chambers are exposed to severe temperature burden, changes in the clearance dimensions of the entire plant are entailed in the course of operation due to operational influences, environmental impacts, temperature differences, and penetration of contaminants into the joints. This leads to an alteration in the position of the chargeholes in the coke oven chamber top, thus making it more difficult to automatize the coal charging procedure. The machines destined for coal charging, therefore, must offset the change in the position of the chargeholes.

A typical method and device for charging coke ovens of a coke oven battery through the top including an offset of the positioning of the charging holes is taught by DE 10145431 C2. This doctrine lays claim to a method for charging coke ovens of a coke oven battery in which a coal charging car is traversed on the oven top in longitudinal direction of a coke oven battery and positioned at pre-determined positions to charge the coke ovens, wherein horizontal deviations in the position of the chargehole frames versus a base position are measured in longitudinal and transversal direction and then saved, and wherein an operating unit comprised of a charging telescope, a lid lifting device, and a frame cleaner and connected movably adjustable to the coal charging car is moved into a position allocated to the actual position of the chargehole frames as prompted by those values saved, and wherein the lid lifter, frame cleaner, and the charging telescope are moved from this position into their relevant working position. The doctrine thus offsets deviations from the original position of the chargehole entailed in the course of coke oven chamber operation by way of a modified positioning of the charging machine during the charging procedure.

However, the expense for this measure is substantial. For this reason, the approach often applied is not to modify the position of the charging machine but to modify the position of the chargehole and to reset it by and large into its original arrangement. To this effect, it is required to take the chargehole out from the structural aperture of the coke oven chamber top and to treat the material of the coke oven chamber top. This is usually only feasible during an interruption of operation, thus prompting increased cost of operation and a worsened economic efficiency of the process.

Now, therefore, measures are searched for to modify the position of the chargeholes in order to compensate for the shifting of these chargeholes due to thermal expansion so that the coal charging machine can perform its periodically and repetitively executed charging cycles into one chargehole constantly in the same position. This can be accomplished only in such a manner that the chargehole is shiftable in its positioning so that a shifting of the chargeholes due to a change in the clearance dimensions during an extended period of operation can be offset.

SUMMARY OF THE INVENTION

Now, therefore, it is the object of the present invention to provide a method which enables a shifting of the exact position of the chargeholes in horizontal direction on the coke oven chamber top, whereby a shifting of the chargeholes from the coke oven chambers due to thermal expansion can be offset, and which does not call for structural measures in the coke oven chamber top.

DETAILED DESCRIPTION OF THE PREFERRED EMBODIMENTS

Figure 1:
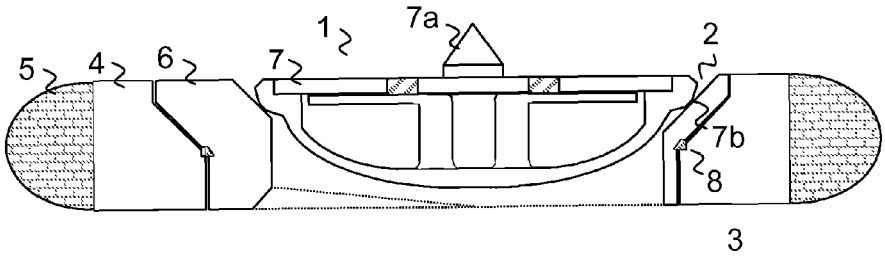
FIG. 1 shows a sectional view of an inventive adjustable chargehole closure in a lateral view.

The present invention solves this task by providing for an adjustable chargehole insert for insertion into a charging aperture for charging the coke oven chambers of a coke oven battery, with the said chargehole insert being comprised of charging apertures, chargehole closure, and chargehole lid, and with the said chargehole closure being comprised of an inner frame and an outer frame, and wherein the chargehole lid is supported by a suitable structure in the inner frame of the chargehole closure, and wherein the inner frame of the chargehole closure is twistable both versus the outer frame and the chargehole lid, and wherein the inner frame is of an asymmetrical configuration so that the aperture arranged in the inner frame and destined for the chargehole lid shifts itself in horizontal direction when twisting the inner frame.

The asymmetry of the inner frame of the chargehole lid can typically be attained by providing for that it does not have an exactly round shape. The inner frame is so shaped that the outer circumference of the inner frame is asymmetrically shifted versus the inner circumference of the inner frame, whereby their corresponding circles are not congruent with their geometrical centers. The frame deviating from the round shape then takes-up the round chargehole lid so that it is shifted when the inner frame is twisted. Although this shifting usually just accounts for a few centimeters, it is sufficient to offset the shifting for another period of operation.

Claim is laid in particular to an adjustable chargehole closure for insertion into a charging aperture for charging the coke oven chambers of a coke oven battery, said arrangement comprised of

- one or more charging apertures, which are at least simply arranged on the top of a coke oven chamber of a coke oven battery, and which represent an aperture in the structural surface structure of the oven top,
- one or more chargehole closures, which are solidly built-in on the top of a coke oven chamber by structural measures into the top of the coke oven chamber of a coke oven battery, and which are equipped as circumferentially extending frames with a projection or a take-up holding device for the chargehole lid,
- a chargehole lid which is comprised of circumferentially extending oblique insertion areas extending vertically downwards towards the interior or comprised of an insertion device supported in a take-up holding device for firm insertion into a chargehole closure, and wherein the chargehole lid is twistable versus the chargehole closure, wherein
- the chargehole closure is comprised of an inner circumferentially extending frame and an outer circumferentially extending frame, and wherein
- the inner frame is insertible into the outer frame through oblique insertion areas extending vertically downwards towards the interior or through an insertion device supported in a take-up holding device, and wherein
- the outer frame is arranged twistable versus the inner frame and the inner frame is arranged twistable versus the chargehole lid, and which is characterized in that

- the inner chargehole frame is asymmetrical in relation to a vertical section plane so that this asymmetry leads to a shifting of the charging aperture and the insertible chargehole lid in the horizontal plane when twisting the inner frame.

The material of the device components may be of any arbitrary configuration, but it should be of an appropriate type so as to withstand high temperatures prevailing on the top of a coke oven chamber. In one embodiment, the outer frame is made of a refractory mineral material. The inner frame, too, is also made of a refractory mineral material in one embodiment. In one embodiment, the refractory mineral material is ceramics or a fireclay brick. In another embodiment, the outer or the inner frame or both frames are made of cast iron or high-temperature resistant steel.

High-temperature resistant steel or cast iron should be resistant to temperatures of at least up to 800° C. This holds for the entire structure of the chargehole closure and the surrounding structural measures as well as the chargehole lid. The choice of material is left to the expert in charge who is expected to choose no material that is unable to withstand the conditions prevailing on a coke oven chamber top. For example, the expert in charge will therefore choose no material which already softens or becomes brittle at 800° C. The material must be of a proper type so as to withstand high temperatures prevailing on a coke oven chamber top and to ensure twisting of the chargehole lid versus the inner frame as well as twisting of the inner frame versus the outer frame.

The outer frame is advantageously firmly integrated into the top of a coke oven chamber. Embedding it with mortar represents a structural measure, for example.

Twistable lids as chargehole apertures in the top of a coke oven chamber are in principle known from prior art. DE 2942805 A1 describes a lid for tight closing of an aperture leading into a coke oven, said lid being comprised of an inner surface and outer surface, with a sealing edge being allocated to the lid body, wherein said sealing edge can be indented with the beveled marginal area of the lid, thus forming a primary sealing for the lid. DE 2732245 B1 describes a closure device for a chargehole of a coke oven chamber with a chargehole lid inserted into a frame, wherein the structural components of the lid and frame and lid which anchor these with each other are sealed versus each other by way of a displaceable powdery material.

However, the devices mentioned hereinabove disclose no means enabling a shifting of the lid in horizontal direction by way of a simple process step. This is the case with the present invention.

Both the outer frame and the inner frame of the present invention are comprised of holding facilities through which the inner frame can be taken up into the outer frame. For example, such facilities are beveled round areas as circumferentially extending rims of the frames, one round area being beveled in the inner rounding of the outer frame and arranged so as to expand upwardly into the frame, and another round area being beveled in the outer rounding of the inner frame and arranged so as to build-up itself outwardly. These areas indent into each other as the inner frame is inserted.

The chargehole lid, too, can also be arbitrarily supported versus the inner frame. For example, these are beveled round areas as circumferentially extending rims of the frames, one round area being beveled in the inner rounding of the outer frame and arranged so as to expand upwardly into the frame, and another round area being beveled in the outer rounding of the inner frame and arranged so as to build-up itself outwardly. These areas indent into each other as the chargehole lid is inserted. The holding facility, however, may be of any arbitrary configuration. For example, it may be a ring nose indenting into a ring channel as disclosed in DE 2732245 B1. This may be executed in this manner for the inner frame versus the outer frame, too.

Claim is also laid to a method for adjusting a chargehole closure on charging of coke oven chambers of a coke oven battery, wherein the chargehole closure of a coke oven chamber is comprised of an inner circumferentially extending frame and an outer circumferentially extending frame;

the outer frame is arranged twistable versus the inner frame; and which is characterized in that the inner frame is asymmetrical in relation to a vertical section plane so that a shifting of the charging aperture in the horizontal plane is executed when the inner frame is twisted so that the charging aperture for charging the coke oven through the top can be correctly positioned.

By twisting the inner asymmetrical frame, the charging aperture in the coke oven top is shifted so that it can be shifted by simply twisting the frame and thus the chargehole aperture remains accessible to the coal charging machine without any new positioning. Twisting the inner frame can be executed both manually and by means of a mechanism. The chargehole lid is inserted again into the inner frame upon completion of the charging procedure.

In one embodiment of the present invention, the outer and the inner frame can be sealed versus each other. The inner chargehole frame and the chargehole lid, too, can be sealed versus each other by means of a sealing material. For example, a sealing cord or a sealing mat can be utilized as sealing material. But it is also possible to use a fillable or smearing sealing compound. For example, this may be sand. Filling the frame or chargehole lid with the sealing compound, for instance, can be accomplished manually. But this can also be executed by way of a refilling mechanism like the one disclosed, for example, in EP 1002850 B1.

The invention can be applied in any type of a coke oven chamber. The inventive device can be utilized once or several times or even in combination with charging apertures known from prior art. The inventive device can be utilized in coke oven chambers which are arranged in coke oven banks of the "Heat-Recovery" or "NonRecovery" type, but it can also be applied in coke oven chambers which are arranged in coke oven batteries of the conventional type.

The invention bears the advantage of enabling an adjustment of the charging aperture for coal arranged on the top of a coke oven chamber so that a deviation from the original arrangement of the charging aperture that is entailed in the course of operating time due to environmental impacts and due to the ingress of contaminants from the coke oven chamber is made possible by a simple twisting of a component. Thereby, a new positioning of the coal charging machine as correction for the deviation of the charging aperture(s) from the home position is not required or the deviations of the charging aperture from the home position can be better offset by the coke oven service machine.

The inventive device is elucidated by way of four drawings, these drawings just representing practical examples for the design and construction of the inventive device.

FIG. 1 shows an adjustable chargehole closure (1) for insertion into a charging aperture (2) to charge the coke oven chambers (3) of a coke oven battery, the said charging closure being comprised of an outer frame (4) which is for example structurally integrated by a mortar into the top (5) of the coke oven chamber. This outer frame (4) forms a component of the chargehole closure. The other component of the chargehole closure is the inner frame (6) which can be twisted versus the outer frame (4). The inner frame (6) is so shaped that the outer circumference of the inner frame (6) is asymmetrically shifted versus the inner circumference, whereby their corresponding circles are not congruent with their geometrical centers. A chargehole lid (7) is arranged in the inner frame (6). The coke oven chamber (3) here is located beneath the chargehole closure. The chargehole lid (7) is comprised of a central vertical rotation axis (7*a*) about which the chargehole lid (7) can be rotated. Moreover, the chargehole lid (7) is comprised of a sealing surface (7*b*) or a similarly configured facility by means of which the chargehole lid (7) is by and large sealed versus the inner frame. (6). The inner frame (6) here is sealed with a sealing compound (8) versus the outer frame (4).

Figure 2:
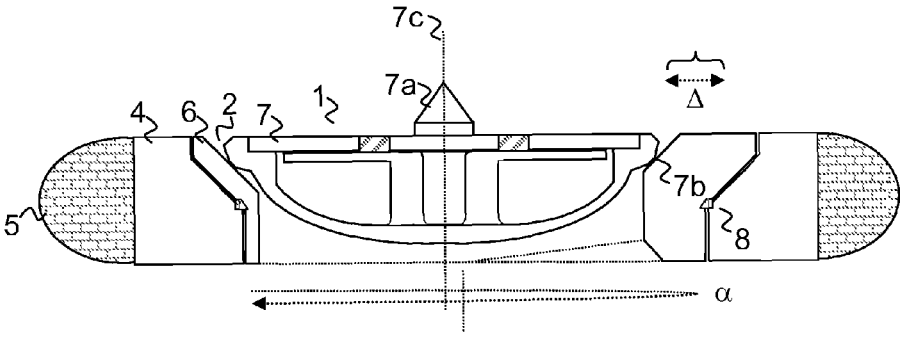
FIG. 2 shows the same device after having turned the lid by 180°.

FIG. 2 shows the same lid (7) after the inner frame (6) has been twisted about the vertical central axis. On twisting the inner frame (6) about an angle $\alpha^{\circ}$ the vertical axis (7*c*) of the chargehole lid is shifted by the amount $\Delta$ (as compared to FIG. 1). Thereby, it is again reachable for the charging machine. If the lid (7) lies in the aperture (2), then its position is shifted by the same amount.

Figure 3:
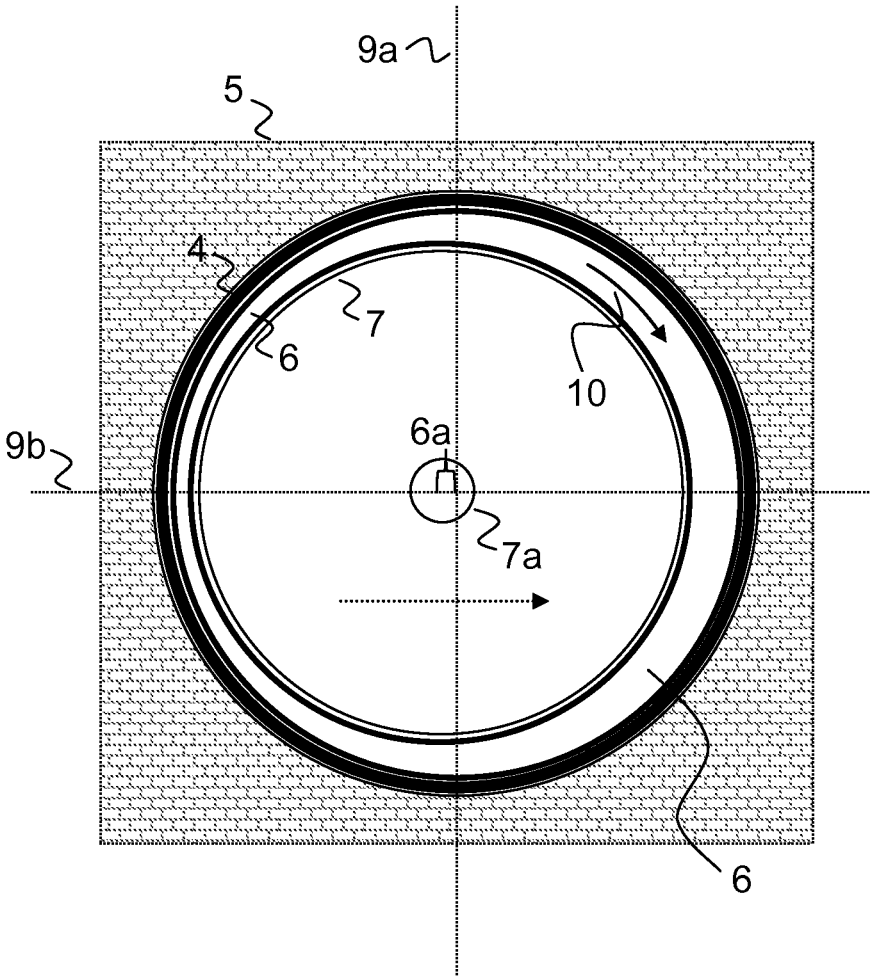
FIG. 3 shows the inventive device in a vertical view from the top.

FIG. 3 shows an adjustable chargehole closure for insertion into a charging aperture (2) for charging the coke oven chambers (3) of a coke oven battery, these being shown in a vertical view from the top. Shown here are the top (5) of the coke oven chamber (3), the outer frame (4), the inner frame (6), and the chargehole lid (7). The inner frame 6) is asymmetrically formed by a shifting of the geometrical centers (6*a*) of the outer circumference and inner circumference. Seated in the inner frame (6) is the chargehole lid (7) which can be rotated about a central vertical axis (7*a*). Also shown here are two imaginary axes (9*a*,9*b*) which show the position of the chargehole lid (7) in the horizontal plane.

Figure 4:
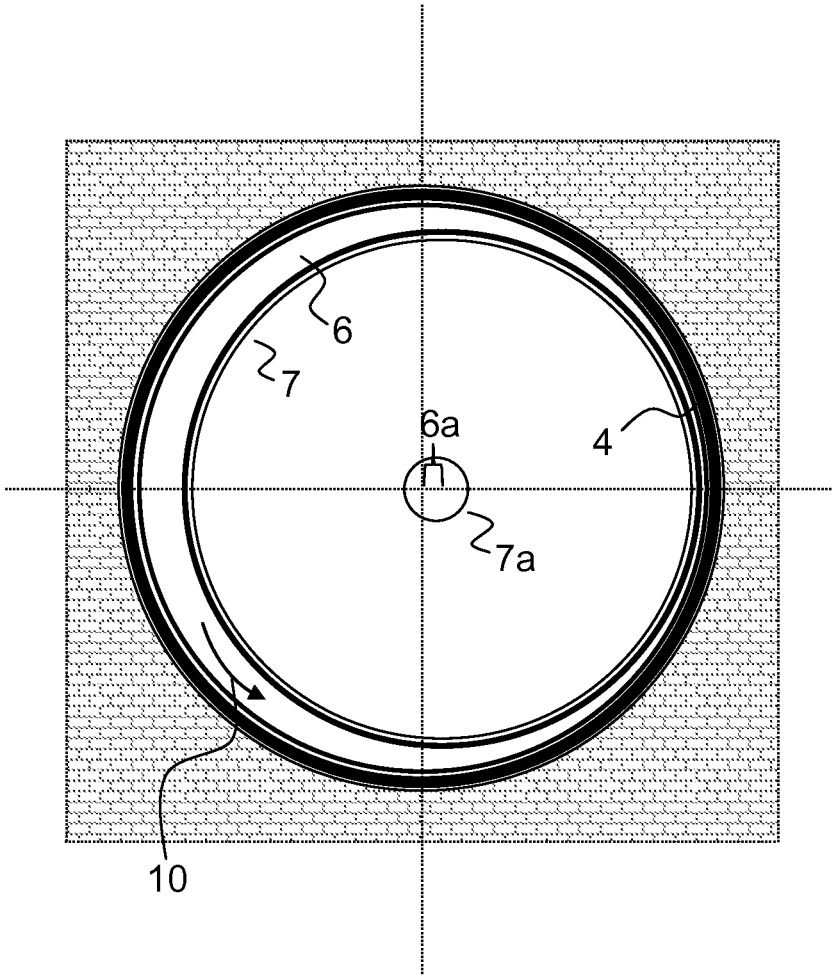
FIG. 4 shows the same device after a turn by 180° in a vertical view from the top.

FIG. 4 shows the same chargehole closure (1), the inner frame (6) of which has been twisted by 180°. The inner frame (6) is inventively rotatable about the central vertical axis (10). By twisting the frame (6), the lid (7) shifts itself in the inner frame (6) by a shifting (6*a*) so that changes in the position and distortions of the charging aperture (2) can thereby be offset.

LIST OF REFERENCE SIGNS

1 Chargehole closure
2 Charging aperture
3 Coke oven chamber
4 Outer frame
5 Top of a coke oven chamber
6 Inner frame
6*a* Shifting of the geometrical centers of the outer circumference and inner circumference of the inner frame

7 Chargehole lid
7*a* Central vertical axis of rotation
7*b* Sealing surface
7*c* Central vertical axis of the chargehole lid
8 Sealing compound
9*a* Imaginary axis in parallel to the coke oven chamber top
9*b* Imaginary axis in parallel to the coke oven chamber top
10 Direction of rotation of the inner frame

The invention claimed is:

1. An adjustable chargehole closure for insertion into a charging aperture for charging a coke oven chamber of a coke oven battery, the closure comprising:

a circumferentially extending outer frame to be structurally integrated by mortar into the top of the coke oven chamber and having a circumferentially extending inner rim being beveled;

a circumferentially extending inner frame, to be inserted into the outer frame, having a circumferentially extending inner rim being beveled and a circumferentially extending outer rim being beveled; and a chargehole lid to be supported by the inner frame having a circumferentially extending outer rim being beveled, wherein the inner frame is twistable both relative to the outer frame and the chargehole lid, and wherein a geometrical center of an outer circumference of the inner frame is offset from a geometrical center of an inner circumference of the inner frame, wherein an aperture arranged in the inner frame, and destined for the chargehole lid, and the chargehole lid are capable of being shifted in a horizontal plane when twisting the inner frame.

2. The chargehole closure of claim 1, wherein the outer frame is made of a refractory mineral material.

3. The chargehole closure of claim 2, wherein the refractory mineral material is ceramic or fireclay brick.

4. The chargehole closure of claim 1, wherein the inner frame is made of a refractory mineral material.

5. The adjustable chargehole closure of claim 1, wherein the outer or inner frame or both frames are made of cast iron or a high-temperature resistant steel.

6. A method for adjusting a chargehole closure on charging the coke oven chambers of a coke oven battery comprising:

rotating an inner circumferentially extending frame of the chargehole closure of a coke oven chamber, wherein the chargehole closure of a coke oven chamber further comprises an outer circumferentially extending frame, and wherein a geometrical center of an outer circumference of the inner frame is offset from a geometrical center of an inner circumference of the inner frame, wherein an aperture arranged in the inner frame is shifted in a horizontal plane when rotating the inner frame so that the aperture arranged in the inner frame for charging the coke oven through the top is correctly positioned.

7. A method for adjusting a chargehole closure on charging the coke oven chambers of a coke oven battery comprising:

providing a circumferentially extending outer frame structurally integrated by mortar into the top of the coke oven chamber and having a beveled circumferentially extending inner rim;

a circumferentially extending inner frame, to be inserted into the outer frame, having a beveled circumferentially extending inner rim and a beveled circumferentially extending outer rim; and a chargehole lid supported by the inner frame, wherein the inner frame is rotatable both relative to the outer frame and the chargehole lid, and wherein a geometrical center of an outer circumference of the inner frame is offset from a geometrical center of an inner circumference of the inner frame, wherein an aperture arranged in the inner frame, for the chargehole lid, and the chargehole lid are shifted in a horizontal plane when rotating the inner frame, and rotating the circumferentially extending inner frame of the chargehole closure of a coke oven chamber.

* * * * *